United States Patent [19]

Miller et al.

[11] Patent Number: 5,022,135

[45] Date of Patent: Jun. 11, 1991

[54] METHOD OF MANUFACTURING A FLUID CONDUIT HAVING EXTERIOR DETAIL

[75] Inventors: Donald E. Miller; Milan A. Virsik, both of Adrian, Mich.

[73] Assignee: Brazeway, Inc., Adrian, Mich.

[21] Appl. No.: 512,002

[22] Filed: Apr. 12, 1990

Related U.S. Application Data

[63] Continuation of Ser. No. 129,225, Dec. 7, 1987, abandoned.

[51] Int. Cl.[5] ..... B21D 26/02; B21D 39/08; B23P 17/00

[52] U.S. Cl. ..... 29/421.1; 72/58; 72/62

[58] Field of Search ..... 29/421.1; 72/58, 59, 72/60, 61, 62

[56] References Cited

U.S. PATENT DOCUMENTS

| | | | |
|---|---|---|---|
| Re. 30,802 | 11/1981 | Rogers, Jr. | 29/421 R |
| 588,804 | 8/1897 | Parish | 72/61 |
| 1,766,098 | 6/1930 | Booth | 72/58 |
| 2,652,121 | 9/1953 | Kearns et al. | 72/61 X |
| 2,742,873 | 4/1956 | Moore | 72/62 |
| 2,770,874 | 11/1956 | Lindow | 72/62 |
| 2,892,254 | 6/1959 | Garvin | 72/58 X |
| 3,088,494 | 5/1963 | Koch et al. | 29/157.3 H X |
| 3,197,975 | 8/1965 | Boling | 29/157.3 R X |
| 3,224,239 | 12/1965 | Hansson | 72/62 |
| 3,292,247 | 12/1966 | Pauls | 29/157.3 V |
| 3,575,025 | 4/1971 | Tominaga et al. | 72/62 |
| 3,625,040 | 12/1971 | De Gain | 72/62 X |
| 3,682,094 | 8/1972 | Greis | 29/130 X |
| 4,041,594 | 8/1977 | Chartet | 29/157.3 C |
| 4,157,607 | 6/1979 | Ernest | 29/156.4 R |
| 4,305,269 | 12/1981 | Kimura | 72/58 |
| 4,347,965 | 9/1982 | Grossman | 29/157.3 C X |
| 4,373,369 | 2/1983 | Schey | 72/349 |
| 4,389,134 | 6/1983 | Colas | 29/525 X |
| 4,400,965 | 8/1983 | Schey | 29/157.3 C X |
| 4,587,701 | 5/1986 | Koisuka et al. | 29/157.3 A |
| 4,620,590 | 11/1986 | Koisuka et al. | 29/157 T X |
| 4,660,269 | 4/1987 | Suzuki | 72/62 X |
| 4,738,012 | 4/1988 | Hughes et al. | 29/421 R X |
| 4,788,843 | 12/1988 | Seaman et al. | 72/58 |

FOREIGN PATENT DOCUMENTS

| | | | |
|---|---|---|---|
| 978386 | 4/1951 | France | 72/62 |
| 51-47567 | 4/1976 | Japan | 72/58 |
| 120560 | 1/1948 | Sweden | 29/421.1 |
| 276247 | 8/1927 | United Kingdom | 72/62 |

*Primary Examiner*—E. Michael Combs
*Attorney, Agent, or Firm*—Krass & Young

[57] ABSTRACT

A method for fabricating metallic conduit and the like having exterior surface details such as beads, bulges and flares by inelastic flow of the metal of an extruded blank which does not exhibit the detail. The process comprises the steps of placing a blank in a high pressure die, injecting oil or other incompressible pressure-transmitting fluid into the blank, and using advancing core punches, pressurizing the fluid to cause the metal of the blank to flow into detail cavities of the die.

10 Claims, 3 Drawing Sheets

METHOD OF MANUFACTURING A FLUID CONDUIT HAVING EXTERIOR DETAIL

This is a continuation of co-pending application Ser. No. 129,225 filed on Dec. 7, 1987, abandoned.

INTRODUCTION

This invention relates to metal-forming processes and an apparatus for carrying out a metal-forming process as well as to a product manufactured by and through the defined method. More specifically, the invention relates to the formation of exterior details on a metal part such as a tubular conduit through the creation of hydraulic pressure in a fluid which is temporarily disposed within the conduit.

BACKGROUND OF THE INVENTION

Exterior details such as beads and ribs are commonly formed on fabricated metal products by a process known as swaging. This process typically involves a series of intermediate steps through which the desired end geometry is reached in a gradual fashion. An example is a refrigeration system component in the form of a metal tube having a continuous circumferential bead adjacent one or both ends of the tube to locate connector tubes and assist in the process of achieving a fluid tight seal between the original tube and the connector tubes by soldering, brazing, welding, or even adhesive bonding. As indicated above, the swaging operation is disadvantageous in that it requires several steps; i e., each step requires its own particular tooling and the performance of the step series is time consuming and often labor-intensive. In addition, swaging operations typically leave the part with detailed geometries which are not especially sharply defined. For example, in the case of an aluminum tube with a circumferential bead adjacent an end opening, it has been found that the swaging operation typically leaves a small radius between the raised bead and the adjacent unraised tubing surface. This radius is undesirable as it interferes with the mating of a connector tube which telescopically fits over the original tube and preferably slides into close adjacent and abutting relationship to the raised circumferential bead.

SUMMARY OF THE INVENTION

The present invention, according to a first aspect thereof, is a process or method for manufacturing a metal conduit having one or various surface details from an extruded blank having the desired metal volume but which, because of the extrusion process, exhibits no detail. In general, the method comprises a forming operation in which the principal components are a suitable die which defines the exterior geometry of the finished product including the surface detail, one or more core punches, hereinafter simply "cores", which are advanced into the die and at least one of which is advanced into the blank, and a regulated quantity of essentially incompressible fluid such as hydraulic oil which is compressed by the operation of the core or cores to non-elastically expand the metal of the blank into essentially conforming relationship with the interior surface of the die by hydraulic pressure. The result is a finished product having the same metal volume as the original blank but exhibiting one or more exterior details which are typically much more sharply defined than those same details would be if resulting from a swaging operation.

In another aspect, the invention comprises the die and core apparatus as well as the oil injecting apparatus which is useful in carrying out the above-defined process.

In still a third aspect, the invention is the finished product which is created through the operation of the apparatus according to the inventive method.

DETAILED DESCRIPTION OF AN ILLUSTRATIVE EMBODIMENT

Figure 1:
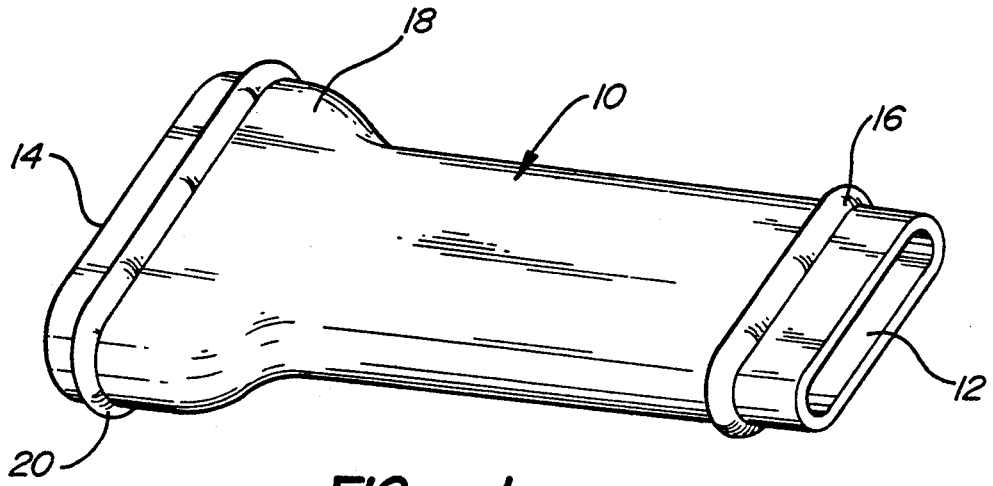
FIG. 1 is a perspective view of a tubular aluminum conduit made in accordance with the inventive method or process.
Figure 2:
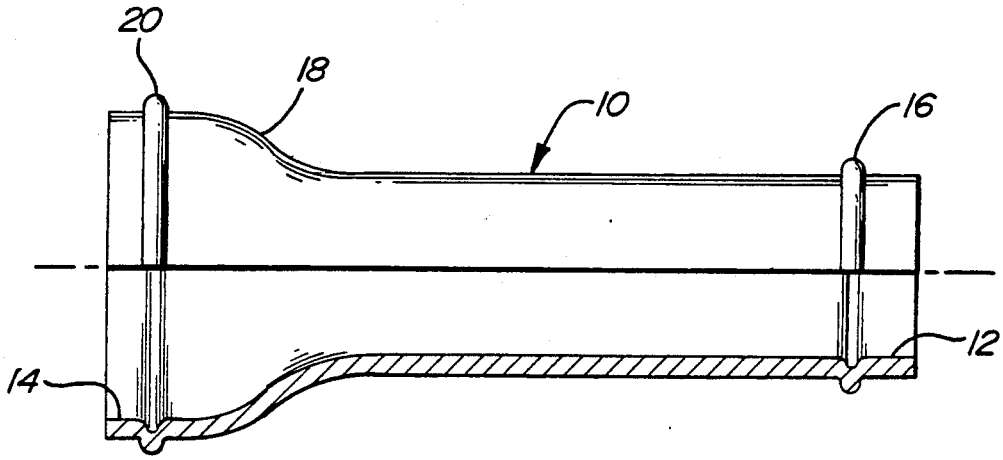
FIG. 2 is a plan view partly in section of the conduit of FIG. 1.

Referring to FIGS. 1 and 2, a representative finished product in the form of a tubular aluminum conduit 10 is shown opening to have opposite end openings 12 and 14 to a continuous interior volume. A first exterior detail appears in the form of a continuous circumferential bead 16 adjacent but spaced from the open end 12. A second detail appears in the form of a flared end 18, and a third detail appears in the form of a continuous circumferential bead 20 which is adjacent but spaced from the open end 14. The body of the conduit 10 between the bead detail 16 and the flare detail 18 is of essentially constant cross section.

It will be noted in FIG. 2 that the flare detail 18 is both interior and exterior as are the bead details 16 and 20. It will also be nOted that the bead detail 16 and 20 are extremely sharp; i.e., there is virtually no radius between the base of the beads and the adjacent tube surface.

Figure 3:
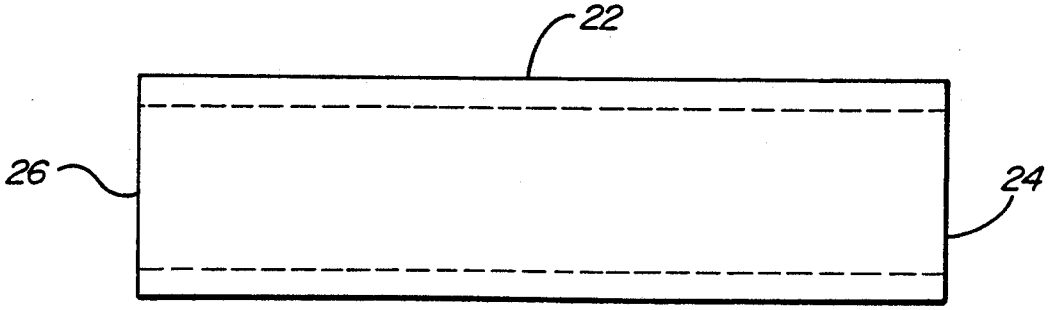
FIG. 3 is a plan view of a blank which is suitable for manufacturing the article of FIGS. 1 and 2 according to the invention.

FIG. 3 shows an aluminum blank 22 having a constant cross section throughout its length and between the opposite open ends 24 and 26. The wall thickness of the blank 22 is also constant over its entire length.

The characteristics of the blank 22 just described are typical of an extruded metal product and, as is well-known to those familiar with the metal extrusion art, it is possible to extrude both interior and exterior details which are longitudinally continuous; i.e., details which follow the extrusion axis. It is not, however, possible to extrude a discontinuous detail which runs transverse to the extrusion axis such as the flare 18 or the beads 16 and 20 shown on the finished product 10 in FIGS. 1 and 2. It should be noted that while the finished product 10 of FIGS. 1 and 2 and the blank 22 of FIG. 3 are flattened or oblong in cross-sectional geometry, the specific cross-sectional shape is not critical to the invention and the steps hereinafter described are readily applicable to other shapes including those which are perfectly symmetrical about a longitudinal axis. Moreover, it should be noted that while the finished product 10 is fabricated from extruded and processed aluminum, the invention is applicable to numerous malleable and machinable metals and alloys of metals; for example, copper, tin, and brass.

Figure 4:
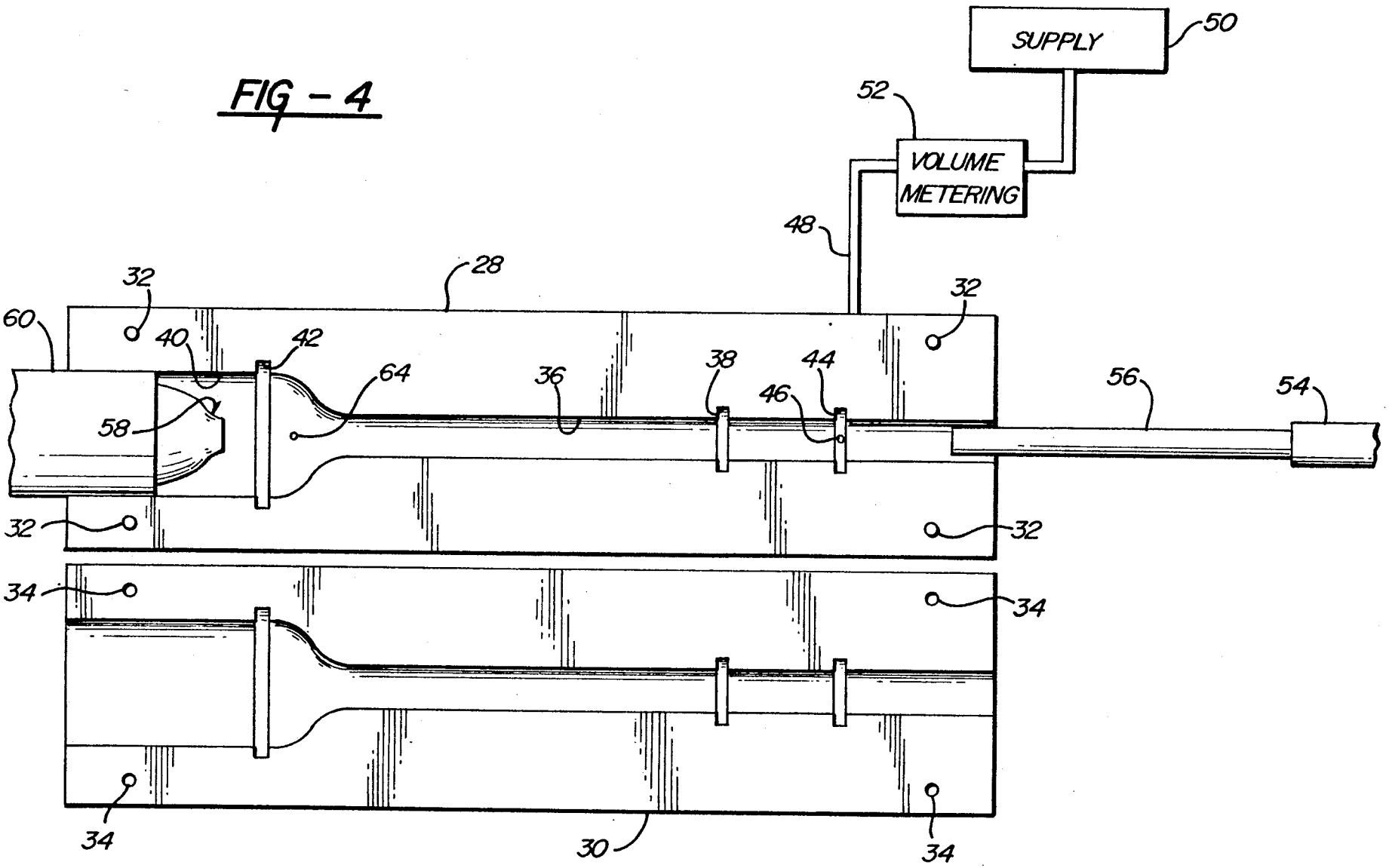
FIG. 4 is a plan view of the essential components of an apparatus which is useful in carrying out the inventive method or process.

Referring now to FIG. 4, an apparatus for carrying out the process of the present invention will be described. FIG. 4 shows two mating clam shell die components 28 and 30 which are joined together by means of pins 32 and receptacle or sockets 34 to form a high pressure hydraulic die capable of withstanding sufficient pressures to cause plastic flow of the metal from which the blank 22 shown in FIG. 3 is fabricated. The die components 28 and 30 are preferably manufactured from machine steel and may represent interchangeable inserts which are suitably fastened into a die carrier assembly so as to permit a given press or manufacturing center to be used at different times to make different finished products simply by exchanging one set of die component inserts for another.

Since the die components 28 and 30 are essentially mirror images of one another, only die component 28 will be described in detail. The die component 28 comprises a continuous interior cavity 36, the geometry or shape and size of which essentially defines the exterior configuration or geometry of the end product 10 shown in FIGS. 1 and 2. The cavity 36 includes an enlarged diameter area 40 that is provided with a first annular groove 42 which defines and corresponds essentially to the bead detail 20 on the finished product. Enlarged diameter area 40 smoothly joins the narrower portion of the cavity 36 to form the flare of the end product. Cavity 36 includes annular groove 38 which forms bead detail 16.

An additional annular groove 44 is provided in spaced relation to groove 38 for the purpose of admitting hydraulic oil through an opening 46 which is the terminus of an oil supply line 48 connected to an oil source 50 through a volume metering valve system 52 for purposes hereinafter described.

The apparatus of FIG. 4 further comprises a first core 54 having a diameter which corresponds closely to the interior diameter of the hollow opening 36 and a long core stem 56 of reduced diameter defining an exterior surface 56*a* corresponding closely but not exactly to the interior dimension of the tubular end product 10 shown in FIGS. 1 and 2. The core 54 is mounted for reciprocal motion along the axis of the hollow 36 in the die component 28 whereby the core 54 may be advanced into the die and withdrawn from the die during different stages of the manufacturing process hereinafter described. Suitable hydraulic rams of sufficient travel and force capacity can be readily selected by those skilled in the related arts.

The apparatus of FIG. 4 further comprises a second core 60 having a seal portion which fits closely within the enlarged diameter area 40 and a tapered end portion 58 defining an exterior surface 58*a* of smoothly changing exterior geometry to define the flare area of the end product 10. Again, the core 60 is reciprocally movable into and out of the die component 28 by means of an appropriate hydraulic press.

Figure 5:
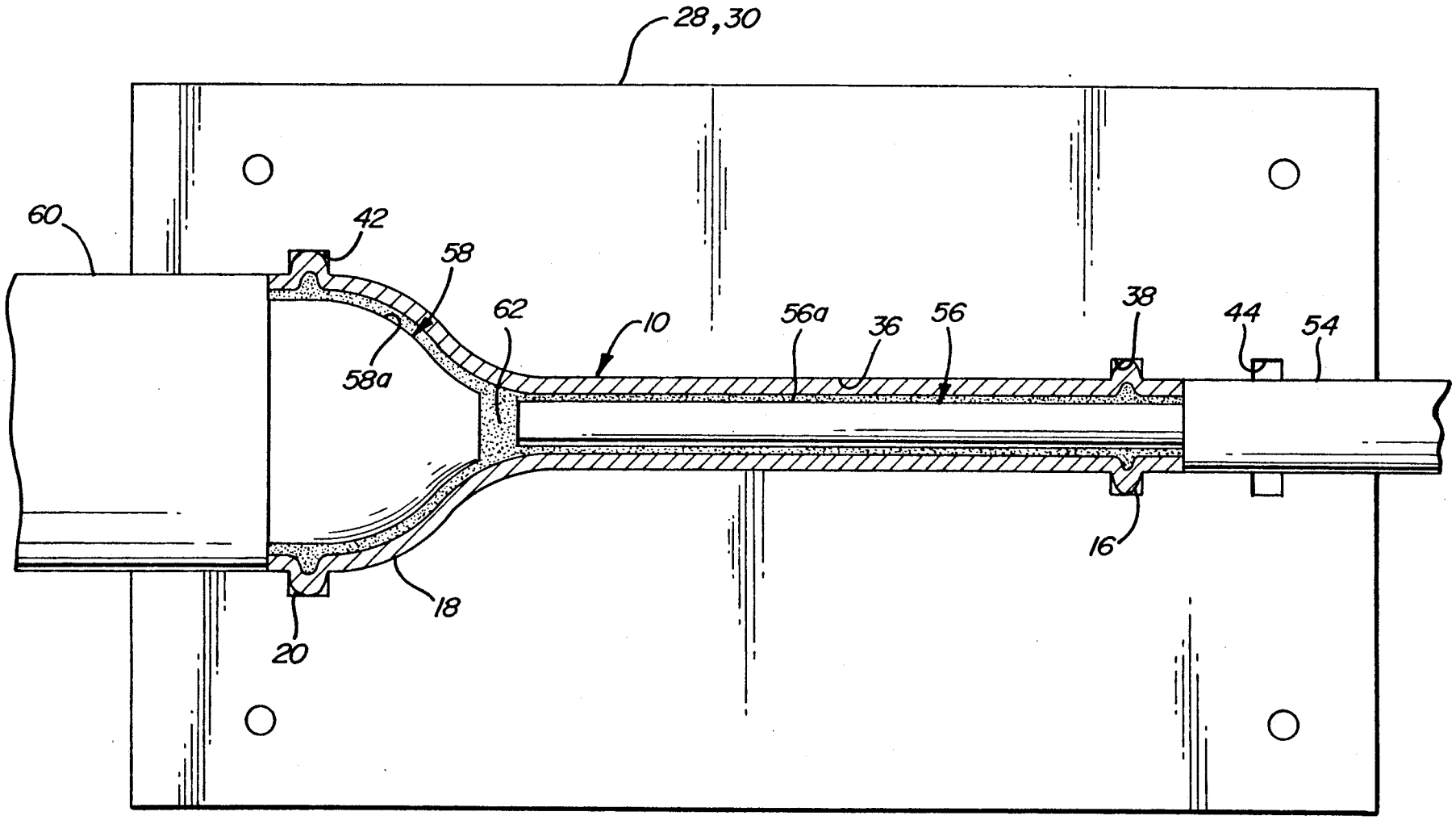
FIG. 5 is a sectional view of a portion of the die of FIG. 4 with the cores sufficiently advanced to create the finished product from a suitable blank.

Looking now to FIG. 5, the condition of the mold apparatus of FIG. 4 at the conclusion of the manufacturing process is shown. From this illustration, the various steps of the process can straightforwardly be described.

In FIG. 5 the cores 54 and 60 are fully advanced into the die consisting of mating components 28 and 30. The finished aluminum conduit 10 is shown within the die 28,30 with the details 16,18 and 20 fully formed by the action of the cores 54 and 60 in creating pressure within a precisely metered volume of hydraulic oil 62 which lies between the exterior surfaces 56*a*, 58*a* of the core details 56 and 58 and the interior surface of the aluminum conduit 10. It will be noted in particular that the bead details 16 and 20 have been formed by non-elastic flow of the metal from the original blank 22 into the annular grooves 38 and 42. It will also be noted that the bead details 16 and 20 do not fully conform in this case to the square shouldered grooves at the major diameters thereof; rather, the bead details 16 and 20 remain fairly rounded over the main portions thereof. However, the joint or intersection between the bead details 16 and 20 and the adjacent tube surfaces are sharply defined.

The essential steps of the process by which the end product 10 is created in the apparatus of FIGS. 3, 4 and 5 can now be defined:

STEP 1—Place the blank 22 in the die 28,30 with the cores 54 and 60 withdrawn. This is typically achieved by dropping the blank 22 into an entry position and thereafter driving it into the die. This can also be achieved by opening the die through the step of separating the die components 28 and 30.

STEP 2—The cores 54 and 60 are advanced into the die 28,30 to perform a number of functions, the most important in the illustrated embodiment being the beginning of the flare 18 at the left end of the blank 22 by mechanical interaction between the exterior surfaces 58*a* of the core portion 58 and the end opening 26 of the blank 22, and the hydraulic sealing of the end openings of the die 28,30 by the larger diameter portions of the cores 54,60. This mechanical forming of the initial portion of the flare ca be achieved by advancing the core 54 fully into the tubular blank 22 until the shoulder of the core between the large diameter portion 54 and the small diameter 56 seats on the end of the tube blank 22 as shown in FIG. 5. However, the nose 58 of the core 60 is only partially pushed into the opening 26 of the tube blank 22. The tube blank 22 effectively forms seals with the die interior 36 and core nose 58 to create air spaces in the detailing features 38, 42.

STEP 3—The metered quantity or volume of hydraulic oil 62 is admitted to the interior of the blank 22. This is achieved first by withdrawing the core 54 until the oil filler opening 46 is exposed and then operating the metering valve system 52 to inject a carefully controlled volume of incompressible hydraulic oil. The core 60 may remain in essentially the same position as it finished in the previous step. Both ends of the die 28,30 remain sealed by the continuing presence of the cores 54 and 60.

STEP 4—The cores 54 and 60 are now fully advanced to pressurize the oil 62 creating a pressure gradient between the now higher pressure oil 62 and the lower pressure air spaces between the metal tube blank 22 and the detailing features 38, 42, and inelastically expand the metal of the tube blank 22 into the detail forming portions of the die to yield the end product 10 shown in FIG. 5.

STEP 5—The die 28,30 is opened and the end product 10 is ejected by means of an ejector pin 64 shown in FIG. 4.

The process may be repeated in an automated high production fashion.

We claim:

1. A process for manufacturing a metal conduit having one or more exterior surface details from an extruded hollow conduit blank, which does not exhibit the detail, comprising the steps of:

providing a die having an interior hollow which essentially defines the exterior geometry of the conduit with the detail and having core entry openings at the opposite ends of said hollow;

placing the conduit blank in the hollow of the die with the respective ends of the conduit blank proximate the respective core entry openings;

sealing the entry openings by causing one core, having a leading end surface conforming essentially to the interior geometry of at least a portion of the finished conduit, to sealingly enter one entry opening and advance into the hollow to move said leading end surface into engagement with one end of the blank and causing another core to sealingly enter the other entry opening;

admitting a predetermined quantity of an essentially incompressible fluid into the interior of the blank while maintaining the entry openings sealed and thereafter;

further advancing said one core leading end surface into said hollow to further advance said leading end thereof into the blank to gradually define a continuous fluid filled volume equal to the volume of the fluid quantity and simultaneously to cause non-elastic flow of the material of the blank into the volume between the fluid filled blank volume and the interior hollow of the die.

2. A method as defined in claim 1 wherein the blank is tubular and the detail on the finished product is a raised bead.

3. The method defined in claim 2 wherein the bead is circumferential.

4. A process as defined in claim 3 wherein the bead is circumferentially continuous.

5. A process as defined in claim 1 wherein the fluid is hydraulic oil.

6. A process as defined in claim 1 wherein the detail is an area of increased diameter in the conduit.

7. A process as defined in claim 6 wherein the area of increased diameter includes a flare adjacent one end of the conduit.

8. A process as defined in claim 1 wherein the die comprises two mating and mirror image die components.

9. A process for manufacturing a metal conduit having one or more exterior surface details from an extruded hollow conduit blank, which does not exhibit the detail, comprising the steps of:

providing a die having an interior hollow which essentially defines the exterior geometry of the conduit with the detail and having core entry openings at the opposite ends of said hollow;

placing the conduit blank in the hollow of the die with the respective ends of the blank proximate the respective core entry openings;

moving a first core through one core entry opening into engagement with one end of the conduit blank;

moving a second core through the other core entry opening into engagement with the other end of the conduit blank;

withdrawing the second core from engagement with the other conduit blank end;

admitting a predetermined quantity of an essentially incompressible fluid into the interior of the blank through the other blank end; and thereafter returning said other core into engagement with said other end of the conduit blank.

10. A process for manufacturing a metal conduit having one or more exterior surface details from an extruded hollow conduit blank, which does not exhibit the detail, comprising the steps of:

providing a die having an interior hollow which essentially defines the exterior geometry of the conduit with the detail and having core entry openings at the opposite ends of said hollow;

placing the conduit blank in the hollow of the die with the respective ends of the conduit blank proximate the respective core entry openings;

sealing the entry openings by causing one core, having a leading end surface conforming essentially to the interior geometry of at least a portion of the finished conduit, to sealingly enter one entry opening and advance into the hollow to move said leading end surface into engagement with one end of the blank and causing another core to sealingly enter the other entry opening;

admitting a predetermined quantity of an essentially incompressible fluid into the interior of the blank while maintaining the entry openings sealed and thereafter;

further advancing said one core into said hollow to further advance said leading end thereof into the blank to gradually define a continuous fluid filled volume equal to the volume of the fluid quantity and simultaneously to cause non-elastic flow of the material of the blank into the volume between the fluid filled blank volume and the interior hollow of the die;

said other core being moved into engagement with the other end of the blank during said sealing step; and said admitting step being achieved by withdrawing said other core from engagement with said other conduit and, while maintaining the seal at said other entry opening, admitting the fluid into the conduit through said other blank end, and thereafter returning said other core into engagement with said other end of said conduit blank.

* * * * *

UNITED STATES PATENT AND TRADEMARK OFFICE

CERTIFICATE OF CORRECTION

PATENT NO. : 5,022,135

DATED : June 11, 1991

INVENTOR(S) : Donald E. Miller, Milan A. Virsik

It is certified that error appears in the above-identified patent and that said Letters Patent is hereby corrected as shown below:

In the abstract, Line 4, Please delete "exhibit.thedetail." and insert -- exhibit the detail. --.

Column 2, Line 43, Please delete "nOted" and insert -- noted --.

Column 4, Line 34, Please delete "ca" and insert -- can --.

Signed and Sealed this

Nineteenth Day of January, 1993

*Attest:*

DOUGLAS B. COMER

*Attesting Officer*

*Acting Commissioner of Patents and Trademarks*